United States Patent [19]

Lange

[11] Patent Number: 4,651,797

[45] Date of Patent: Mar. 24, 1987

[54] ROLL-UP SCREEN DOOR

[76] Inventor: Al E. Lange, 9633 S. Keebs Ave., Oak Lawn, Ill. 60453

[21] Appl. No.: 843,565

[22] Filed: Mar. 25, 1986

[51] Int. Cl.[4] ..... E06B 9/08

[52] U.S. Cl. ..... 160/290 F; 160/28

[58] Field of Search ..... 160/290 R, 290 F, 23 R, 160/D6–D8, 28, 27

[56] References Cited

U.S. PATENT DOCUMENTS

| | | | |
|---|---|---|---|
| 778,228 | 12/1904 | Dodge et al. | 160/DIG. 8 |
| 839,282 | 12/1906 | Forsyth | 160/290 F |
| 1,015,413 | 1/1912 | Wood | 160/318 |
| 1,960,434 | 5/1934 | Doscher | 160/23 YR |
| 3,050,742 | 8/1962 | Munson | 160/290 R |
| 3,371,702 | 3/1968 | Keegan et al. | 160/392 |

*Primary Examiner*—Reinaldo P. Machado
*Assistant Examiner*—Cherney S. Lieberman
*Attorney, Agent, or Firm*—Robert E. Browne; Amy L. H. Rockwell

[57] ABSTRACT

A roll-up screen door includes a long, narrow housing having a length adapted to extend vertically for the full height of a door casement opening. The housing contains a conventional spring-biased roll upon which is initially wound a large sheet of flexible screen material, one end of which is secured to the roll so that the screen material can be unwound from the roll against the tension of the roll. When the housing is mounted adjacent to one side of the vertical trim strip along one side of the door casement opening, the screen material passes through a longitudinal exit slot in the housing in a plane located inwardly of the front face of the vertical trim strip, so that the screen material sealingly engages the adjacent vertical trim strip when it is stretched across the door opening. The front vertical edge portion of the sheet of screen material extends into and is anchored within a vertical groove formed in the inner end of a main curved body portion of a sealing and anchoring strip which extends for the full height of the door opening. The sealing and anchoring strip has extending inwardly of opposite sides of the sheet of screen material handle-forming projections which can be gripped when the sheet of screen material is in its door-covering position. The main body portion of the strip has a slot which receives an anchoring pin extending from one of the vertical trim strips. The curved body portion of the strip is held in sealing engagement with the latter vertical trim strip by this anchoring pin.

3 Claims, 6 Drawing Figures

ROLL-UP SCREEN DOOR

DESCRIPTION

1. Technical Field

This invention relates to screen doors for door casement openings on the outside of homes and the like where the openings have on the outside margins thereof vertical trim strips connected by a horizontal trim strip at the upper ends thereof and a threshold at the bottom ends thereof. More particularly, this invention relates to a screen door construction which lends itself to installation, where desired, by unskilled persons, like homeowners.

2. Background Prior Art

Generally, screen doors are large, heavy pre-assembled structures comprising wooden or metal frames with screen material mounted in the frames. Such screen door constructions require installation by skilled persons, like carpenters and the like. Most of these screen doors must be mounted on pivot hinges so that the screen door pivot between their closed and opened positions. There has been obviously a need for a unique screen door construction which is inexpensive to construct, is light in weight, and can be easily installed by unskilled persons.

SUMMARY OF THE INVENTION

In accordance with one of the features of the invention, a roll-up screen unit includes a spring-biased roll preferably enclosed in a long and relatively narrow housing adapted to be mounted adjacent to and to extend for the full height of a door casement frame of a given vertical dimension (most of which are of standard size). A sheet of flexible screen material has preferably one end thereof secured to a spring-biased roll in and extending substantially the full length of the housing, and is initially wound on the roll so that the spring tension on the roll retracts the screen material in a wound condition upon the roll. The outer vertical end portion of the sheet of screen material is anchored to the inner margin of a rigid sealing and anchoring strip made of metal or the like, which remains accessible on the outside of the housing. This sealing and anchoring strip, which has a length at least equal to the height of the door casement opening involved, has gripping flanges or handles on the forward and rearward facing sides of the sealing and anchoring strip where the handles are respectively grippable from the front of the screen unit and from within the door casement opening.

When the housing is mounted in place, the screen material passes out of the housing through a vertical longitudinal exit slot positioned in a vertical plane located inwardly of the front face of the adjacent vertical trim strip of the door casement opening, so that the screen material sealingly engages the trim strip when it is stretched across the door opening. The sealing and anchoring strip has a main body portion extending preferably the full length thereof, with a curved inner face which fits the most commonly shaped outer face of the vertical trim strip on the opposite side of the door opening from the side where the housing is mounted. This main body portion of the sealing and anchoring strip preferably has a horizontal slot for receiving an anchoring pin projecting forwardly from the latter vertical trim strip. When the vertical sealing and anchoring strip is pulled into position over the latter vertical trim strip and the horizontal slot thereof is positioned over the pin, the strip will be held in place by the anchoring pin against the spring-tension on the spring-biased roll, and the curved inner face of the main body portion of the strip sealingly engages the front face of the vertical trim strip. The point at which the screen material is anchored to the main body portion of the strip is in a vertical plane inwardly of the outermost portions of the trim strip at the top of the door casement opening and the treshold at the bottom of the door casement opening so that the screen material will sealingly engage with this trim strip and threshold. The flexible screen material stretched over and covering the door casement opening can be returned to its rolled-up condition within the housing of the roll-up screen door of the invention by simply grasping one of the handles accessible from the side of the screen door involved, and then pushing on the handle in a direction to release the main body portion of the sealing and anchoring strip from the anchoring pin. The spring tension on the spring-biased roll will then automatically retract the sheet of screen material in a rolled-up condition within said housing provided therefor.

It is apparent that the present invention has thus provided an extremely inexpensively-constructed and easy-to-install roll-up screen door which provides an effective seal around the casement door opening so that insects and the like cannot readily pass through the casement door opening involved.

While roll-up flexible doors and rollup window screens have been heretofore mounted on vertical rolls contained in vertical housings mounted respectively along one side of door openings or window openings, as, for example, disclosed in U.S. Pat. Nos. 778,228; 1,015,413; 1,958,695; 1,960,434; and, 2,015,993, the concept or a roll-up screen door for a door casement opening has not, to my knowledge, been developed and/or marketed. The various roll-up screen constructions disclosed in all but the first of these patents are not suitable for a roll-up screen door construction, such as one where a seal should most desirably be provided along the trim strips and threshold extending around the casement opening. The roll-up screen door disclosed in U.S. Pat. No. 778,228 is of such a complex and expensive construction that it is not suitable for practical use as a screen door. Also, this door is not designed to form a seal along the trim strips and threshold at the margins of a door casement opening.

The previously-described and other advantages and features of the invention will become apparent upon making reference to the specification and claims to follow and the drawings. For example, other unique features of the invention relate to the configuration of the sealing and anchoring strip which, among other advantages, permit the ready connection of the outer vertical edge portion of the flexible screen material to the inner margin of the main body portion of the sealing and anchoring strip described.

BRIEF DESCRIPTION OF SEVERAL VIEWS OF DRAWINGS

Figures 1A, 1B, 2, 3, 4, 5:
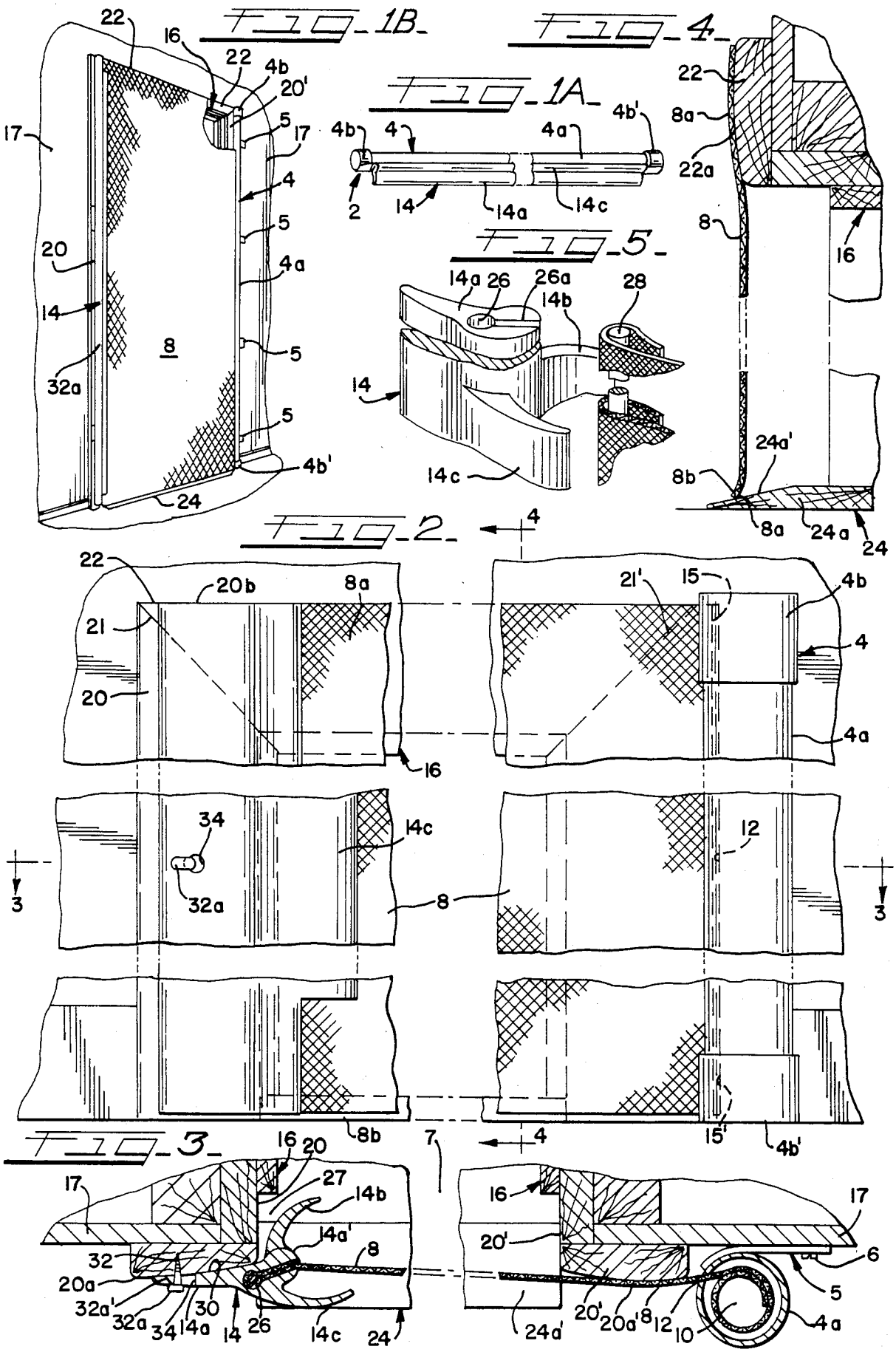
FIG. 1A is a view of the screen door unit of the invention in its rolled-up, compact condition and before it is mounted on one side of a door casement opening.
FIG. 1B is a perspective view of the roll-up screen door unit of the invention mounted in place and where the screen door portion thereof is pulled into a door opening covering position.
FIG. 2 is a greatly-enlarged, fragmentary elevational view of the roll-up screen door unit as shown in FIG. 1B.
FIG. 3 is a horizontal sectional view through the roll-up screen door unit of FIG. 2, taken along section line 3—3 therein, and shows the manner in which the screen door makes sealing engagement with the vertical trim strips on the opposite sides of the door casement opening.

FIG. 4 is a vertical sectional view of the roll-up screen door unit of FIG. 2, taken along section line 4—4 therein, and shows the manner in which the flexible screen material makes sealing engagement with the horizontal trim strip and the threshold respectively at the top and bottom of the door casement opening; and, FIG. 5 is a fragmentary perspective view of the upper portion of the sealing and anchoring strip showing the manner in which the outer vertical edge portion of the flexible screen material of the door unit is mounted within a groove of the sealing and anchoring strip.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring now to the drawings, the roll-up screen door unit of the invention 2 may include a long narrow housing 4 including a cylindrical main body portion 4*a* closed by removable end caps 4*b*–4*b*'. The housing includes a number of mounting brackets 5 welded to the rearwardly-facing side of the main body portion 4*a*, which brackets are adapted to receive anchoring screws 6 for anchoring the housing along one vertical margin of a door casement opening 7. A large rectangular sheet 8 of screen material sized to cover the door casement opening 7 has its inner end portion secured to a spring-biased roll 10, which may be a conventional-type roll which has a stable initial position which can be rotated away from that initial position against a return spring tension. Such rolls are so common as not to require any further description thereof. The sheet 8 of screen material passes through openings in the housing formed by a longitudinal slot 12 in the main body portion 4*a* and slots 15–15' aligned therewith formed in the end caps 4*b*–4*b*'. The outer end portion of the sheet 8 of screen material connected to a sealing and anchoring strip 14, which may be an extruded aluminum member. The spring tension on the roll 10 normally urges the sheet 8 of the screen material into a wound condition upon the roll 10. In such condition, the strip 14 will be initially drawn against the cylindrical body portion 4*a* of the housing 4, as shown in FIG. 1A.

The configurations and dimensions of the various parts of the roll-up screen door unit are such as to form an effective seal around the margins of a typical door casement opening on the outside of a building which normally includes a casement frame 16 defining the opening 7. The casement frame 16 is generally secured in a wall 17, and one side of the juncture between the casement frame 16 and the wall 17 are framed by a pair of horizontally-spaced vertical trim strips 20–20' secured to the corresponding side of the unit 17. The vertical trim strips generally have vertical outer surfaces 20*a*–20*a*' facing away (i.e., forwardly) from the door casement opening 7 involved, the outer surfaces 20*a*–20*a*' curving inwardly toward the door opening 7, as shown in FIG. 3. The vertical trim strips 20–20' join an upper horizontal trim strip 22 which is shown joining the vertical trim strips at mitered joints 21–21'. The upper horizontal vertical trim strip 22 has an exposed outer vertical surface 22*a* which forms a continuation of the vertical outer surfaces 20*a*–20*a* vertical, of the trim strips 20–20', which surface 22*a* accordingly has a similar curvature to that of the surfaces 20*a*–20*a*'. A conventional threshold strip 24 having a forwardly-tapering front end portion 24*a* with an inclined upper surface 24*a*' extends between the bottom ends of the vertical trim strips 20–20'.

As shown in FIG. 2, the housing 4 has a length so that it extends between and overlaps the innermost margins of the horizontal trim strip 22 and the threshold 24. The longitudinal dimension of the sheet 8 of screen material, that is the dimension thereof parallel to the length of the main body portion 4*a* of the housing 4, extends substantially for the full length of this main body portion 4*a* so that it engages the vertical outer surface 22*a* of the upper horizontal trim strip and the inclined upper surface 24*a*' of the threshold 24, as best shown in FIG. 4, when the sheet 8 of screen material is unwound from the roll 10 so as to cover the door casement opening 7.

As previously explained, the sheet 8 of screen material passes out of the housing 4 through slots 12 and 15–15' in the main body portion 4*a* and the end caps 4*b*–4*b*' of the housing. These slots are so positioned that when the housing 4 has been mounted on the wall 17 adjacent to vertical trim strip 20', as shown in FIG. 3, the defining walls of these slots confine the sheet 8 of the screen material to a vertical plane parallel to and located inwardly (i.e., rearwardly) of the plane of the outermost points of the vertical outer surface 20*a*' of the strip 20', so that the sheet 8 of screen material will sealingly wipe against these surfaces when it is held in its door casement opening/closing position by the sealing and anchoring strip 14 in a manner to be described.

The length of the sealing and anchoring strip 14 is such that it extends at least across the vertical dimension of the door casement opening so that it overlaps the adjacent ends (i.e., the innermost margins) of the horizontal trim strip 22 and the threshold strip 24. The sealing and anchoring strip is provided with a main body portion 14*a* which is relatively thin and has a curved inner surface 30 complementary in shape to the curved outer surface 20*a* of the standard vertical trim strips, like vertical trim strip 20, so that it can make a good sealing contact therewith. The main body portion 14*a* terminates in an inner end portion 14*a*' which has a preferably cylindrically-shaped longitudinal slot 26 running for the full length of the main body portion 14*a* of the sealing and anchoring strip 14. As shown in FIG. 2, the cylindrical slot 26 communicates with the outer surface of the inner end of the main body portion 14*a* through a narrow entryway 26*a*. The curved inner surface 30 of the main body portion 14*a* extends to the inner end of the sealing and anchoring strip 14 to provide a surface which will engage with the outer surface of the horizontal trim strip 22 and with the threshold strip 24.

The trim strips 20, 20' and 22 are positioned outwardly of the outermost faces of door casement frame 16 so that a clearance space, like space 27 in FIG. 3, is provided for handle-forming portions 14*b*–14*c*, preferably projecting as curved flanges from the inner end 14*a*′ of the main body portion 14*a* of the sealing and anchoring strip 14. These handle-forming portions 14*b*–14*c*, which are respectively accessible from opposite sides of the screen unit of the invention, terminate well short of the ends of the sealing and anchoring strip 14, so that they cannot contact the horizontal trim strip 22 or the threshold strip 24. Accordingly, because of the shapes and dimensions of the various portions of the sealing and anchoring strip just described, it can extend for at least the full height of the door casement opening and engage with the horizontal trim strip 22 and the threshold strip 24 where it can support the flexible screen material in a wiping, sealing relationship with the strips in a manner to be more fully described hereinafter.

The outer end portion of the sheet 8 of screen material is anchored in the slot 26 in the main body portion 14*a* of the sealing and anchoring strip 14 in any suitable way. Preferably, such means include a rubber-like cylindrical anchoring strip 28 around which is curled the outer end of the sheet 8 of screen material. The anchoring strip 28 is initially stretched longitudinally so that it can slip into the slot 26 through the entryway 26*a*. When the tension of the rubber-like strip 28 is released, it will expand into screen material-anchoring relationship with the defining walls of the slot 26.

An anchoring pin 32 for holding the sealing and anchoring strip against the vertical trim strip is secured to the vertical trim strip 20 at a point where it is within reach of young children and adults, the pin 32 having an enlarged head 32*a* spaced from the trim strip surface 20*a* to form a latching groove 32*a*. The main body portion 14*a* of the sealing and anchoring strip 14 has a horizontal slot 34 positioned to receive the head 32*a* of the anchoring pin 32. When the main body portion 14*a* of the sealing and anchoring strip 14 is positioned over the anchoring pin 32, the tension on the spring-biased roll 10 within the housing 4 will draw the strip 14 into the position shown in FIG. 3, where the strip is received in the pin latching groove 32*a*′. The curved inner surface 30 of the main body portion 14*a* of the strip then makes a sealing engagement with the curved outer vertical surface 20*a* of the trims strip 20. The opening of the slot 26 of the sealing and anchoring strip 14, which receives the outer end portion of the screen material, curled around the anchoring strip 28, is located rearwardly of the plane of the outermost vertical surface of the threshold 24 so that the sheet 8 of screen material is held in a vertical plane spaced rearwardly or inwardly of the outermost points of the surfaces 20*a*, 20*a*′ and 22*a*′ of the trim strips 20, 20′ and 22′, respectively. Accordingly, the uppermost margin 8*a* of the sheet 8 of screen material wipes and seals against the vertical outer surface 22*a* of the horizontal trim strip 22. In the latched position of the screen door unit of the invention just described, the bottom margin portion 8*b* of the sheet 8 of screen material preferably wipes and seals against the inclined upper surface 24*a*′ of the threshold strip 24 (FIG. 4) to form a seal therealong.

The roll-up screen unit of the invention can be returned from its extended door-closing latch position shown in FIG. 3 to its retracted position where the sheet 8 of screen material is substantially fully wound upon the roll 10 in the housing 4 by grasping the accessible flange 14*b* or 14*c* and moving the sealing and anchoring strip 14 away from the trim strip surface 20*a* to release the strip from the anchoring pin 32.

It should be apparent that the rollup door unit of the invention is exceedingly easy to fabricate, relatively inexpensive, compact, easy-to-carry and easy-to-install unit, and forms an effective seal with the threshold strips and trim not commonly found at the margins of door casement openings.

It should be understood that numerous modifications may be made in the most preferred form of the invention shown in the drawings without deviating from the broader aspects of the invention. For example, while the housing 4 is shown with mounting brackets 5 welded thereto for anchoring the housing to the wall 17, the mounting brackets can be replaced by apertured members completely separate from the housing 4 which are mountable upon the wall 17 opposite the points where the housing end caps 4*b*–4*b*′ are to be located. These end caps would then be provided with projections which frictionally and slidably engage apertures in these brackets.

I claim:

1. In combination with a door casement opening mounted in a vertical wall, vertical trim strips secured to said wall on opposite vertical sides of said door casement opening and having exposed outer vertical surfaces facing forwardly away from one side of the plane of said opening, a horizontal trim strip mounted on said wall at the top of said opening and extend between the upper ends of said vertical trim strips and having an exposed vertical surface facing fowardly away from said one side of the plane of said opening, and a threshold extending between the bottom ends of said vertical trim strips, a screen door unit comprising:

(a) screen material support means having a length at least equal to the distance between the innermost margins of said horizontal trim strip and said threshold;

(b) means on said screen material support means mounting the same on said vertical wall adjacent to one side of one of said vertical trim strips so that said screen material support means extends vertically between and beyond the horizontal extensions of the innermost margins of said horizontal trim strip and said threshold;

(c) a spring-biased roll means on said screen material support means;

(d) a sheet of flexible screen material of a width to extend between and overlap said horizontal trim strip and said threshold, the inner end portion of said sheet of screen material being connected to said roll means, said sheet of screen material being at least partially unwound from said roll means against a return spring tension of the roll means along a path which brings it into wiping engagement against the adjacent vertical trim strip;

(e) an anchoring and screenreceiving strip anchored at the forward side of said door casement opening at the other vertical trim strip, said anchoring and screenreceiving strip having a screen-receiving portion extending rearwardly of the plane of the outermost vertical surfaces of the vertical and horizontal trim strips, the outer end portion of the screen material being connected to the rear end portion of said screenreceiving portion of said anchoring strip where the outer end portion of the screen material is held in a position rearwardly of the plane of the outermost vertical surfaces of the vertical and horizontal trim strips, to position the screen material in wiping engagement with said horizontal trim strip and contiguous to said threshold;

(f) releasable anchoring means on said anchoring and screen-receiving strip releasably anchoring the same at said other vertical trim strip so that the screen door unit seals against all of said trim strips; and, (g) said anchoring and screen-receiving strip having both on the forward- and rearward-facing sides thereof handle means respectively grippable from the front of said screen door unit and from within the door casement opening for moving the anchoring and screen-receiving strip from its anchored position to a retracted position after release thereof from its anchored position.

2. The combination of claim 1, wherein said anchoring and screen-receiving strip has a sealing portion engaging and sealing against said other vertical trim strip for at least the height of the door casement opening.

3. The combination of claim 1, wherein said screen-receiving portion of said anchoring strip and screen-receiving strip inclines rearwardly towards the door casement opening and has a slot inclining in the same direction and opening to receive the screen material in a vertical plane spaced rearwardly of the surfaces of the anchoring portion which engage said other vertical trim strip.

* * * * *

UNITED STATES PATENT AND TRADEMARK OFFICE

CERTIFICATE OF CORRECTION

PATENT NO. : 4,651,797

DATED : March 24, 1987

INVENTOR(S) : Al E. Lange

It is certified that error appears in the above-identified patent and that said Letters Patent is hereby corrected as shown below:

On the Title Page:

Inventor AL E. LANGE's address in Oak Lawn, Illinois is shown incorrectly; Inventor LANGE's correct address is as follows:

9633 S. Keeler Avenue, Oak Lawn, Illinois 60453

Signed and Sealed this

Eleventh Day of August, 1987

*Attest:*

DONALD J. QUIGG

*Attesting Officer*

*Commissioner of Patents and Trademarks*